US006913777B2

(12) United States Patent
Rebhorn et al.

(10) Patent No.: US 6,913,777 B2
(45) Date of Patent: Jul. 5, 2005

(54) PORTABLE, SIDE-BY-SIDE COMPARTMENT CONTAINER AND METHOD FOR SEPARATELY STORING AND DISPENSING TWO CONSUMABLE PRODUCTS, ESPECIALLY CEREAL AND MILK

(75) Inventors: John P. Rebhorn, Maple Grove, MN (US); Stephen P. Belko, Blackwood, NJ (US); Pamela A. Hodulik, Dunellen, NJ (US)

(73) Assignee: General Mills, Inc., Minneapolis, MN (US)

( * ) Notice: Subject to any disclaimer, the term of this patent is extended or adjusted under 35 U.S.C. 154(b) by 600 days.

(21) Appl. No.: 09/781,582

(22) Filed: Feb. 12, 2001

(65) Prior Publication Data

US 2002/0110623 A1 Aug. 15, 2002

(51) Int. Cl.[7] ..... B65B 3/00; B65D 85/00

(52) U.S. Cl. ..... 426/394; 426/399; 426/115; 426/120; 222/129; 215/6; 220/23.4; 220/505; 220/524; 206/217

(58) Field of Search ..... 426/120, 115, 426/394, 399; 215/6, 10; 220/505, 524, 23.4, 23.83, 23.1; 222/94, 129; 206/217

(56) References Cited

U.S. PATENT DOCUMENTS 674,989 A * 5/1901 Ritz
766,587 A 8/1904 Bradshaw
1,363,064 A * 12/1920 Stegath
2,026,449 A * 12/1935 Ward
2,170,311 A * 8/1939 Smith
2,661,871 A 12/1953 Huenergardt
2,756,875 A 7/1956 Yochim
2,826,338 A * 3/1958 Davis
3,052,368 A 9/1962 Atkins
3,194,426 A 7/1965 Brown
3,288,344 A 11/1966 Woollen et al.
3,298,185 A 1/1967 Loudon
3,378,168 A 4/1968 Hildebrandt
3,442,435 A 5/1969 Ludder et al.
3,567,105 A 3/1971 McFarlin
3,603,485 A 9/1971 Vivier
3,729,553 A * 4/1973 Gold et al.
3,851,800 A 12/1974 Swain
3,983,994 A 10/1976 Wyslotsky
4,069,940 A 1/1978 Naimoli
4,116,354 A 9/1978 Kenkare et al.
4,148,417 A * 4/1979 Simmons ..... 222/94
4,194,619 A 3/1980 Schley
4,196,808 A * 4/1980 Pardo ..... 206/432
4,221,291 A 9/1980 Hunt
4,233,325 A 11/1980 Slangan et al.
4,277,000 A * 7/1981 Jaarsma ..... 222/142.4

(Continued)

*Primary Examiner*—Milton I. Cano
*Assistant Examiner*—Robert Madsen
(74) *Attorney, Agent, or Firm*—John A. O'Toole; Timothy A. Czaja; Douglas J. Taylor

(57) ABSTRACT

A portable, single-use container for separately containing a first and second consumable products. The container includes a first compartment and a second compartment. The first compartment tapers at an upper portion thereof to form a spout. The spout facilitates dispensing of a contained first consumable product from the first compartment. The second compartment, in turn, tapers at an upper portion thereof to form a mouth. The mouth facilitates dispensing of a second consumable product from the second compartment. The first and second compartments are assembled to one another in a side-by-side fashion such that the spout abuts the mouth. With this configuration, during use, a first consumable product and a second consumable product can be dispensed from the container in close proximity to one another for convenient consumption. In one preferred embodiment, the first compartment contains a volume of milk and the second compartment contains a quantity of cereal.

46 Claims, 5 Drawing Sheets

U.S. PATENT DOCUMENTS 4,312,473 A 1/1982 Hoeller
4,482,047 A 11/1984 Ackermann et al.
4,558,804 A 12/1985 Keck
4,703,849 A 11/1987 Vezirian et al.
4,793,323 A 12/1988 Guida et al.
4,836,370 A 6/1989 Bosshard
4,875,576 A 10/1989 Torgrimson et al.
4,927,012 A 5/1990 Rowe
4,955,503 A 9/1990 Propes
4,993,595 A 2/1991 Bertram et al.
4,996,823 A 3/1991 Byrne
5,027,980 A 7/1991 Bell
5,143,261 A 9/1992 Drobish
5,158,191 A 10/1992 Douglas et al.
5,167,973 A 12/1992 Snyder
5,180,079 A 1/1993 Jeng
5,209,348 A 5/1993 Schafer, III
5,209,909 A 5/1993 Siegel et al.
5,215,214 A 6/1993 Lev et al.
5,241,835 A 9/1993 Ascone
5,289,950 A 3/1994 Gentile
5,316,159 A 5/1994 Douglas et al.
5,318,787 A 6/1994 Brauner et al.
5,328,051 A 7/1994 Potter et al.
5,341,953 A 8/1994 Forester
5,366,103 A 11/1994 Abernathy et al.
5,407,278 A 4/1995 Beer
5,447,236 A 9/1995 Perry et al.
5,464,150 A 11/1995 Porres Sanchez et al.
5,482,170 A 1/1996 Semersky et al.
5,496,575 A 3/1996 Newarski
5,514,394 A 5/1996 Lenahan
5,588,561 A 12/1996 Ness
RE35,437 E 2/1997 Ascone
5,607,072 A * 3/1997 Rigney et al. ..... 215/10
5,676,244 A 10/1997 Green et al.
5,705,212 A 1/1998 Atkinson
5,706,980 A 1/1998 Dickerson
5,727,679 A 3/1998 Newarski
5,735,422 A * 4/1998 Binter ..... 220/4.21
5,753,289 A 5/1998 Ness
5,921,440 A * 7/1999 Maines ..... 222/145.2
5,927,538 A 7/1999 Collins
5,954,213 A * 9/1999 Gerhart et al. ..... 215/10
5,971,197 A 10/1999 Everette et al.
6,022,570 A 2/2000 Richmond
6,060,097 A 5/2000 Grigoryan
6,079,586 A * 6/2000 Hanneman ..... 220/256
6,254,907 B1 7/2001 Galomb
6,264,068 B1 7/2001 Ours et al.
6,273,299 B1 8/2001 Hernowitz et al.

* cited by examiner

PORTABLE, SIDE-BY-SIDE COMPARTMENT CONTAINER AND METHOD FOR SEPARATELY STORING AND DISPENSING TWO CONSUMABLE PRODUCTS, ESPECIALLY CEREAL AND MILK

BACKGROUND OF THE INVENTION

The present invention relates to a unitary container that separately contains two consumable products, preferably a dry consumable product and a liquid consumable product. More particularly, it relates to a portable, single-use container that contains both a liquid product and a dry product, such as milk and cereal, and promotes single-handed, simultaneous dispensing of the products.

A highly popular combination food item is dry cereal and milk. Typically, the cereal and milk are combined in a bowl, and then consumed using a spoon. Thus, so long as the consumer is at a stationary location and has a table and spoon available, the cereal and milk meal is readily prepared and eaten. Unfortunately, however, it is virtually impossible to easily consume the milk and cereal while traveling (or "on-the-go") due to the open nature of the bowl and the requirement of a spoon. For example, it is highly difficult to carry a bowl of cereal and milk without spilling the combination product (e.g., walking, hiking, traveling in an automobile, etc.). Further, on-the-go consumption (i.e., no convenient structure such as a table onto which the bowl can be placed) occupies both of the user's hands; one hand holding the bowl and the other hand holding the spoon.

This lack of transportability is in direct contrast to recent consumer preferences. In particular, consumers have expressed a heightened desire for their favorite consumable products to be packaged in single-serving containers that facilitate convenient, single-handed, on-the-go consumption. In fact, manufacturers have now made available a wide variety of food products in portable, single-handed consumption packages or containers. For example, beverages, such as soda pop, milk, etc., are commonly sold in single-serving containers. Other food products, ranging from yogurt to dry snack foods, are also similarly packaged. In general terms, the packaging technique for these products is relatively straightforward in that only a single type of consumable item is contained. In other words, a single-serving beverage container need only define a single storage region for containing the beverage. Similarly, a snack food package has a single compartment enclosing a single type of snack food. In direct contrast, a container for cereal and milk must separately contain the two items prior to consumption. If the cereal and milk were initially combined within a single compartment, the quality of the cereal would quickly deteriorate, as would the milk.

Efforts have been made to provide packaging that separately contains a single-serving of cereal and a single-serving of milk. For the most part, however, these packaging efforts still require a spoon for consumption of the combined cereal and milk, and thus do not promote on-the-go consumption. Alternatively, a hand-held container defining a first compartment for milk and a second compartment for cereal has been proposed, for example, by Ness, U.S. Pat. No. 5,753,289. While satisfying several consumer preferences, the prior single container, dual compartment design raises additional potential drawbacks.

As a starting point, to be viable on a mass production basis, the milk compartment must be sanitized, preferably aseptically sterilized, prior to filling with milk, to provide an extended shelf life or ultra-pasteurized product for sale to consumers. With this in mind, the container of U.S. Pat. No. 5,753,289 utilizes a single screw cap to close integrally formed cereal and milk compartments. Unfortunately, because both compartments are fully exposed when the cap is removed, it is virtually impossible for the product manufacturer to sterilize the container, fill the compartments with cereal and milk in an acceptably sterile environment, and then seal the container without negatively impacting the quality of the milk and/or cereal. In other words, if the milk is dispensed before the cereal is placed within the cereal compartment, the subsequent cereal dispensement will destroy the requisite sterility of the milk compartment. Conversely, if the cereal compartment is filled first and then the milk compartment is sanitized, the sanitizing agent will likely contact the cereal, rendering it inedible. Further, if a consumer attempts to re-use the container, he/she will likely not appreciate the level of cleanliness required of a milk container, and may not properly sanitize the device.

An untapped consumer demand exists for a portable, combination cereal and milk packaged good item. Unfortunately, existing designs either hinder on-the-go consumption, or present potentially insurmountable manufacturing obstacles. Therefore, a need exists for a portable, single-use packaged good item that separately contains both a dry consumable product, such as cereal, and a liquid consumable product, such as milk, and a method of manufacturing such an item.

SUMMARY OF THE INVENTION

One aspect of the present invention relates to a portable, single-use container for separately containing first and second consumable products. The container includes a first compartment and a second compartment. The first compartment tapers at an upper portion thereof to form a spout. The spout facilitates dispensing of a contained first consumable product from the first compartment. The second compartment, in turn, tapers at an upper portion thereof to form a mouth. The mouth facilitates dispensing of a second consumable product from the second compartment. The first and second compartments are assembled to one another in a side-by-side fashion such that the spout abuts the mouth. With this configuration, during use, a first consumable product and a second consumable product can be dispensed from the container in close proximity to one another for convenient consumption. In one preferred embodiment, the first compartment contains a volume of milk and the second compartment contains a quantity of cereal.

Another aspect of the present invention relates to a portable, single-use container for separately containing first and second consumable products. The container includes a first compartment, a second compartment, a first compartment opening and a second compartment opening. The first and second compartments are secured to one another in a side-by-side fashion, and combine to define a container body. The first compartment opening is provided for dispensing a first consumable product from the first compartment. In this regard, the first compartment opening has a transverse cross-sectional area that is less than a maximum transverse cross-sectional area of the first compartment. The second compartment opening is similarly provided for dispensing a second consumable product from the second compartment. In this regard, the second compartment opening has a transverse cross-sectional area that is less than a maximum transverse cross-sectional area of the second compartment. Upon final assembly, at least one of the first and second compartment openings is substantially centered relative to the container body. In one preferred embodiment, the first and second compartment openings are positioned side-by-side to define a container pour region that is substantially aligned with a central axis of the container body. With this preferred configuration, the consumable products will readily flow from the container during a pouring operation. In another preferred embodiment, the first compartment contains a volume of milk, whereas the second compartment contains a quantity of cereal.

Another aspect of the present invention relates to a method of manufacturing a portable, single-use container that separately contains a first consumable product and a second consumable product. First and second compartments are provided. The first compartment is configured to contain the first consumable product and tapers at an upper portion thereof to form a spout. The second compartment is configured to contain the second consumable product and tapers at an upper portion thereof to form a mouth. Further, the first and second compartments are configured for assembly to one another in a side-by-side fashion such that the spout abuts the mouth. The first compartment is sanitized, and the first consumable product is dispensed therein. The spout is covered to seal the first consumable product within the first compartment. The second consumable product is dispensed into the second compartment. The first and second compartments are assembled to one another, and the mouth of the second compartment covered. In one preferred embodiment, the mouth and the spout are encompassed by a common cover. Regardless, the method of the present invention allows for sealed containment of a first consumable product, preferably milk, in a sterile environment, preferably an aseptically sterile environment. Upon final assembly, the spout abuts the mouth such that milk and the second consumable product, preferably ready-to-eat cereal, can be poured from the container in close proximity to each other.

DESCRIPTION OF THE PREFERRED EMBODIMENTS

Figure 1:
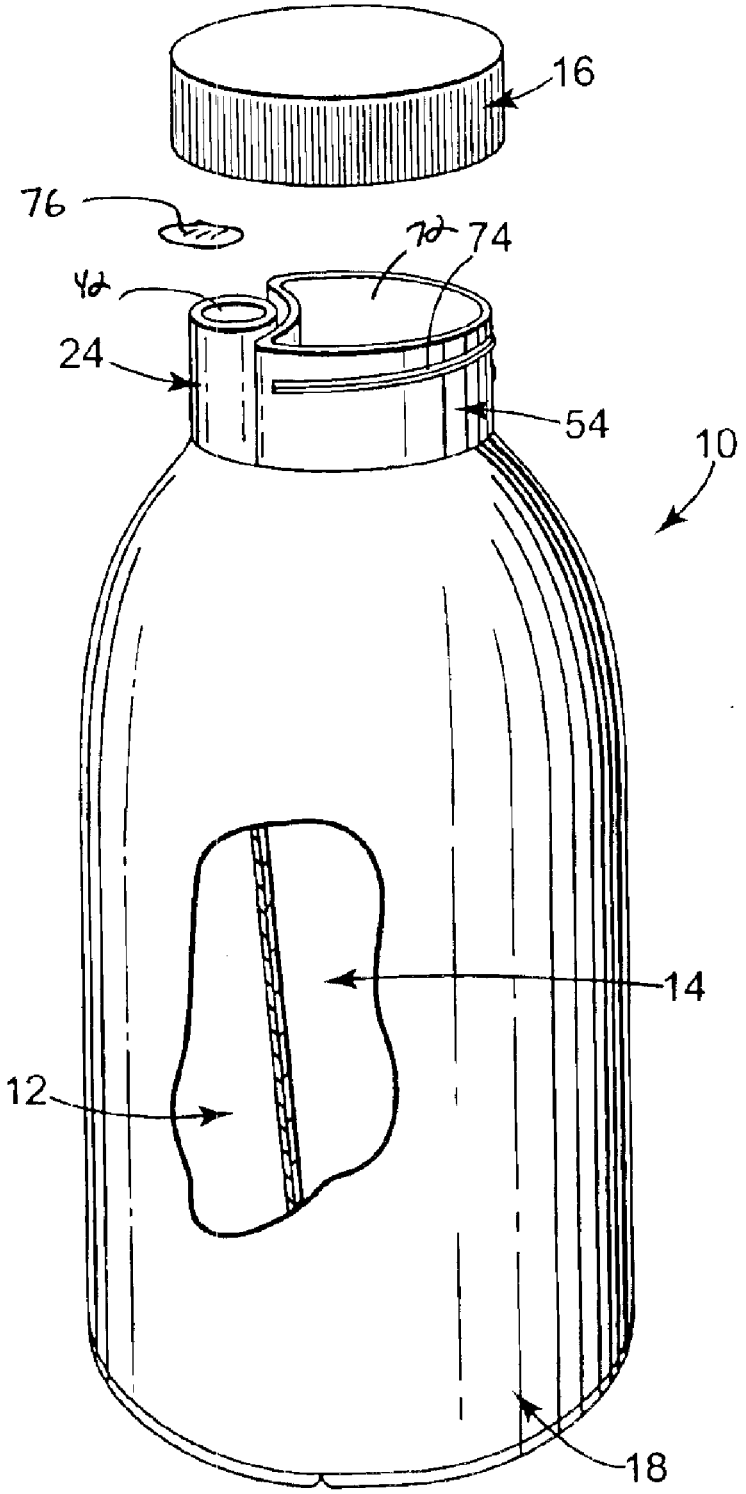
FIG. 1 is a side, partially exploded view of a container in accordance with the present invention.

One preferred embodiment of a container 10 in accordance with the present invention is provided in FIG. 1. The container 10 includes a first compartment 12, a second compartment 14, a cap 16, and a wrapper 18. As a point of reference, a portion of the wrapper 18 has been removed from the view of FIG. 1 to better illustrate the first and second compartments 12, 14. Details on the various components are described below. In general terms, however, the container 10 utilizes a "dual bottle" design, whereby the first compartment 12 is assembled to the second compartment 14 in a side-by-side fashion. In this regard, the wrapper 18 assists in securing the compartments 12, 14 to one another, and the cap 16 covers at least the second compartment 14. With this configuration, a consumable product (not shown), such as cereal, can be contained within the second compartment 14, and another consumable product (not shown), such as milk, can be separately contained within the first compartment 12. As described below, the form of the consumable products (i.e., liquid and dry) contained by the respective compartments 12, 14 can be reversed, or the compartments 12, 14 can both contain a liquid consumable product or a dry consumable product. With the most preferred embodiment described below, the first compartment 12 is described as containing a liquid consumable product and the second compartment 14 as containing a dry consumable product. This description is merely for purposes of illustration and is in no way limiting. Regardless, upon removal of at least the cap 16, the consumable products can be substantially simultaneously dispensed from the container 10 in close proximity to one another.

Figure 2:
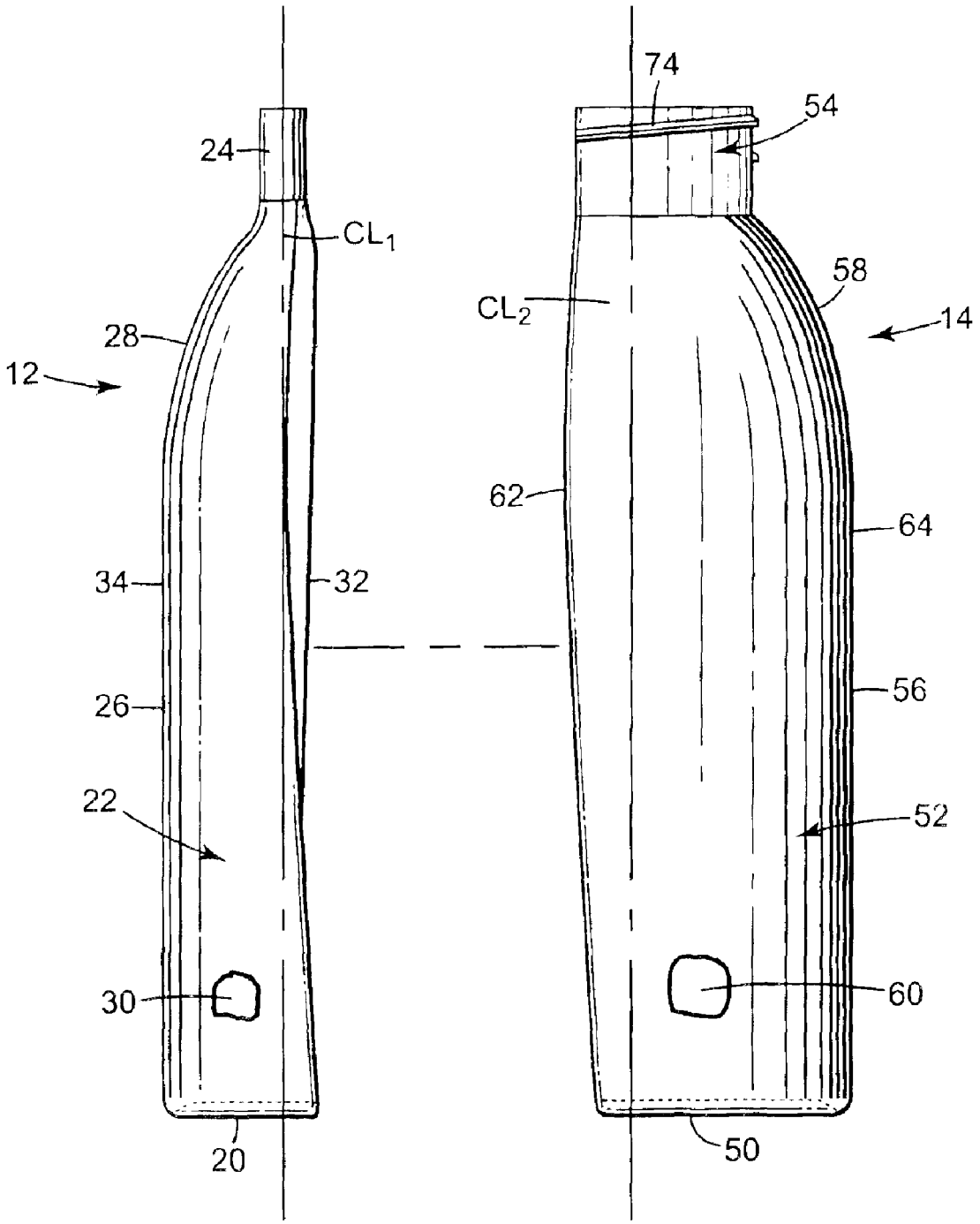
FIG. 2 is a side, exploded view of a portion of the container of FIG. 1.

As shown more clearly in FIG. 2, the first compartment 12 includes a bottom 20, a side wall 22 and a spout 24. The side wall 22 extends from the bottom 20 and defines a body portion 26 and a neck 28. Further, the side wall 22 defines an internal storage region 30. The neck 28 extends from the body portion 26, tapering in outer dimension to the spout 24. Thus, in a preferred embodiment, the first compartment 12 tapers at an upper portion thereof (e.g., the neck 28) to form the spout 24. Directional terminology, such as "upper," "lower," "top," and "bottom" are used for purposes of illustration only and with reference to a desired upright orientation of the container 10 as shown in FIGS. 1 and 2. However, the container 10 can be positioned in other orientations such that the directional terminology is in no way limiting.

As made clearer below, the first compartment 12 is configured for assembly to the second compartment 14 in a side-by-side fashion. Thus, the side wall 22 can be referenced as having an interior surface 32 and an exterior surface 34, it being understood that upon final assembly, the interior surface 32 will be placed against a corresponding surface of the second compartment 14 and thus "hidden", whereas the exterior surface 34 is exposed. With this designation in mind, and with additional reference to FIG. 3, the exterior surface 34 of at least the body portion 26 preferably defines an arcuate, transverse perimeter. The radius of curvature of the arcuate, transverse perimeter corresponds with that of the second compartment 14, described in greater detail below. Conversely, the interior surface 32 of the body portion 26 is configured to correspond in shape and contour with a corresponding surface of the second compartment 14, as described below.

Returning to FIG. 2, a preferred longitudinal contour of the first compartment 12 is best described with reference to a first compartment vertical center line ($CL_1$ in FIG. 2). In particular, the interior surface 32 is preferably angularly oriented relative to the center line $CL_1$, tapering generally inwardly (toward the center line $CL_1$) from the bottom 20 to the spout 24, such that the bottom 20 defines a greater transverse outer dimension (preferably a radius) than the body portion 26 adjacent the neck 28. Conversely, the exterior surface 34 along the body portion 26 is substantially parallel relative to the center line $CL_1$. As shown in FIG. 2, the exterior surface 34 along the neck 28 has a curved longitudinal contour, tapering inwardly relative to the center line $CL_1$. Alternatively, a wide variety of other shapes or contours are also acceptable.

Figure 3:
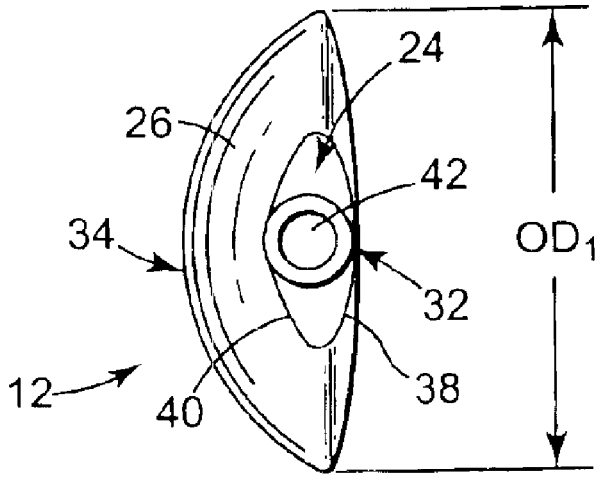
FIG. 3 is a top view of a first compartment portion of the container of FIG. 1.

As best shown in FIG. 2, the spout 24 extends upwardly from the neck 28, and is generally aligned with the interior surface 32 of the neck 28 and the body portion 26. With respect to the exterior surface 34 of the first compartment 12, the spout 24 is transversely offset from a majority of the body portion 26, as shown in FIG. 3. More particularly, and as previously described, the exterior surface 34 of the body portion 26 defines a maximum transverse outer dimension (preferably a diameter) for the first compartment 12 (designated as $OD_1$ in FIG. 3). The neck 28 is contoured and tapers such that the spout 24 is substantially transversely centered relative to the maximum transverse outer dimension $OD_1$, and thus transversely spaced or offset from the exterior surface 34 of the body portion 26.

The spout 24 preferably includes an inner wall 38 and an outer wall 40 (the terms "inner" and "outer" being in reference to a position of the spout 24 relative to the second compartment 14 (FIG. 2) upon final assembly), and forms a longitudinal passage 42. The passage 42 is fluidly connected to the internal storage region 30 (FIG. 2), and facilitates dispensing of a contained product (not shown) therefrom. The inner wall 38 and the outer wall 40 are preferably both convex in transverse cross-section, such that the spout 24 is transversely convexo-convex. The convex transverse shape of the inner wall 38 conforms to a corresponding portion of the second compartment 14 (FIG. 2) for reasons described below. The preferred convex transverse shape of the outer wall 38 similarly corresponds with a portion of the second compartment 14 and promotes placement of the spout 24 within a user's mouth (not shown) during use. Alternatively, other shapes are also acceptable.

Returning to FIG. 2, the first compartment 12, including the body portion 26, the neck 28, and the spout 24, is preferably integrally formed from a plastic material. In particular, the first compartment 12 is preferably conducive to aseptic sterilization, and is therefore formed by a blow molding process or a "blow-fill-seal" (or "form-fill-seal") process as known in the art, utilizing polyethylene, polypropylene, polyethylene/polypropylene co-polymers, etc. Preferably, the material selected for the first compartment 12 is relatively flexible or "squeezable," whereby in response to a user imparted squeezing force, the body portion 26 will temporarily deflect inwardly. This action causes a temporary reduction in a volume of the internal storage region 30, such that a liquid consumable product (not shown) contained therein in accordance with one preferred embodiment will be more rapidly forced to the spout 24, and thus dispensed therefrom. Alternatively, other techniques or materials may be employed. For example, the first compartment 12 can be formed from glass.

Regardless of the exact construction and with additional references to FIG. 3, the integrally formed first compartment 12 preferably conforms to several dimensional constraints. For example, the first compartment 12 is preferably constructed to contain a single-serving volume of liquid consumable product (not shown). Thus, in one preferred embodiment, the internal storage region 30 is sized to contain approximately 130 mL (4.4 fluid ounces) of a liquid consumable product. In light of this preferred volume, the bottom 20 and the body portion 26 both provide a maximum outer dimension (preferably diameter) $OD_1$ of approximately 2.4 inches (±0.5 inch). A height of the first compartment 12 (from the bottom 20 to a top of the spout 24) is preferably approximately 5.4 inches (±0.5 inch), with the spout 24 having a preferred height of approximately 0.45 inch (±0.1 inch). Finally, the passage 42 formed by the spout 24 is preferably sized to promote controlled flow of a liquid consumable product therefrom, and is thus preferably circular in transverse cross-section, having a diameter of approximately 0.25 inch (±0.05 inch). Alternatively, other dimensions are also acceptable for the first compartment 12. For example, the passage 42 can assume a more elongated transverse configuration, such as an oval, rectangle, etc. Further, the first compartment 12 can contain a dry consumable product.

In general terms, the second compartment 14 is configured to correspond in shape and size with the first compartment 12, and includes a bottom 50, a side wall 52 and a mouth 54 as shown in FIG. 2. The side wall 52 extends upwardly from the bottom 50, and forms a body portion 56 and a neck 58. The side wall 52 and the bottom 50 combine to form an internal storage region 60 preferably configured to contain a dry consumable product (not shown). The neck 58 extends from the body portion 56, tapering inwardly to the mouth 54. Thus, in a preferred embodiment, the second compartment 14 tapers at an upper portion thereof to form the mouth 54.

As previously described, the second compartment 14 is configured for assembly to the first compartment 12 in a side-by-side fashion. Thus, the side wall 52 can be referenced as having an interior surface 62 and an exterior surface 64, it being understood that upon final assembly, the interior surface 62 will be placed against the corresponding interior surface 32 of the first compartment 12 and thus "hidden", whereas the exterior surface 64 is exposed. With this designation in mind, and with additional reference to FIG. 4, the exterior surface 64 of at least the body portion 56 preferably defines an arcuate, transverse perimeter. The radius of curvature of the arcuate, transverse perimeter corresponds with that of the exterior surface 34 of the first compartment 12. Conversely, the interior surface 62 of the body portion 56 is configured to correspond in shape and contour with the interior surface 32 of the first compartment 12.

Returning to FIG. 2, a preferred longitudinal contour of the second compartment 14 is best described with reference to a second compartment vertical center line ($CL_2$ in FIG. 2). In particular, the interior surface 52 is preferably angularly oriented relative to the center line $CL_2$, extending generally outwardly (away from the center line $CL_2$) from the bottom 50 to the mouth 54, such that the bottom 50 defines a lesser transverse outer dimension (preferably a diameter) than the body portion 56 adjacent the neck 58. Conversely, the exterior surface 64 along the body portion 56 is substantially parallel relative to the center line $CL_2$. As shown in FIG. 2, the exterior surface 54 along the neck 58 has a curved longitudinal contour, tapering inwardly relative to the center line $CL_2$. Alternatively, a wide variety of other shapes or contours are also acceptable. However, for reasons made clear below, a taper of the neck 58 of the second compartment 14 is, in one preferred embodiment, less gradual than that of the neck 28 of the first compartment 12.

Figure 4:
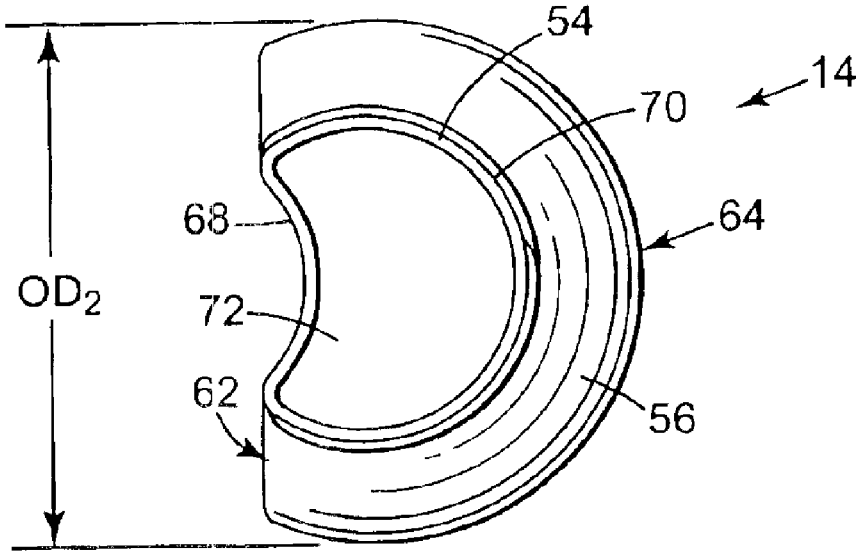
FIG. 4 is a top view of a second compartment portion of the container of FIG. 1.

As best shown in FIG. 2, the mouth 54 extends upwardly from the neck 58, and is generally aligned with the interior surface 62 of the neck 58. With respect to the exterior surface 64 of the second compartment 14, the mouth 54 is transversely offset from a majority of the body portion 56, as shown in FIG. 4. More particularly, and as previously described, the exterior surface 64 of the body portion 56 defines a maximum transverse outer dimension (preferably a diameter) for the second compartment 14 (designated as $OD_2$ in FIG. 4). The neck 58 is contoured and tapers such that the mouth 54 is substantially transversely centered relative to the maximum transverse outer dimension $OD_2$, and thus transversely spaced or offset from the exterior surface 64 of the body portion 56.

The mouth 54 preferably includes an inner wall 68 and an outer wall 70 (the terms "inner" and "outer" being in reference to a position of the mouth 54 relative to the spout 24 (FIG. 3) upon final assembly), and forms an opening 72. The opening 72 is fluidly connected to the internal storage region 60 (FIG. 2), and facilitates dispensing of a contained product (not shown) therefrom. The inner wall 68 is sized and shaped to effectively receive or mate with the inner wall 38 of the first compartment spout 24, and is thus preferably concave in transverse cross-section. Conversely, the outer wall 70 preferably defines an arcuate or circular transverse perimeter. The arc length and diameter of the outer wall 70 corresponds with that of the outer wall 40 (FIG. 3) of the first compartment spout 24, such that upon final assembly, the outer walls 40, 70 combine to form a relatively continuous circle in transverse cross-section, as described in greater detail below. Finally, as best shown in FIG. 2, an interrupted thread 74 is preferably formed along an exterior portion of the outer wall 70. The thread 74 is sized to threadably receive the cap 16 (FIG. 1).

The opening 72 preferably has a transverse shape corresponding with that of the inner and outer walls 68, 70. Thus, as shown in FIG. 4, the opening 72 has a crescent-like transverse, cross-sectional shape.

The second compartment 14, including the body portion 56, the neck 58, and the mouth 54, is preferably integrally formed from a plastic material. In particular, the second compartment 12 is preferably blow-molded from an appropriate plastic material such as high density polyethylene, although other materials, including low density polyethylene, polypropylene, etc. As compared to the first compartment 12 previously described and in accordance with one preferred embodiment, the second compartment 14 need not incorporate a preferably flexible or "squeezable" construction. That is to say, the second compartment 14 is preferably more rigid than the first compartment 12. Alternatively, other techniques or materials may be employed. For example, the second compartment 14 can be formed from glass.

Regardless of the exact construction, the integrally formed second compartment 14 preferably conforms to several dimensional constraints. For example, the second compartment 14 is preferably constructed to contain a single-serving quantity of dry consumable product (not shown). Thus, in one preferred embodiment, the internal storage region 60 is sized to contain approximately 210 mL (7.1 fluid ounces) of a dry consumable product. In light of this preferred volume and to facilitate a uniform appearance upon assembly to the first compartment 12 (FIG. 2), the bottom 50 and the body portion 56 both provide a maximum outer dimension (preferably diameter) $OD_2$ of approximately 2.4 inches (±0.5 inch). A height of the second compartment 14 (from the bottom 50 to a top of the mouth 54) is preferably approximately 5.5 inches (±0.5 inch) (or slightly taller than the first compartment 12), with the mouth 54 having a preferred height of approximately 0.5 inch (±0.1 inch). Finally, the opening 72 formed by the mouth 54 is preferably sized to promote controlled flow of a dry consumable product therefrom, and corresponds with the crescent transverse shape of the mouth 54. With this in mind, the opening 72 is generally transversely defined by a convex diameter (via the outer wall 70) of approximately 1.5 inch (±0.5 inch). Alternatively, other dimensions are also acceptable for the second compartment 14. Further, the second compartment 14 can contain a liquid consumable product.

Figure 5A:
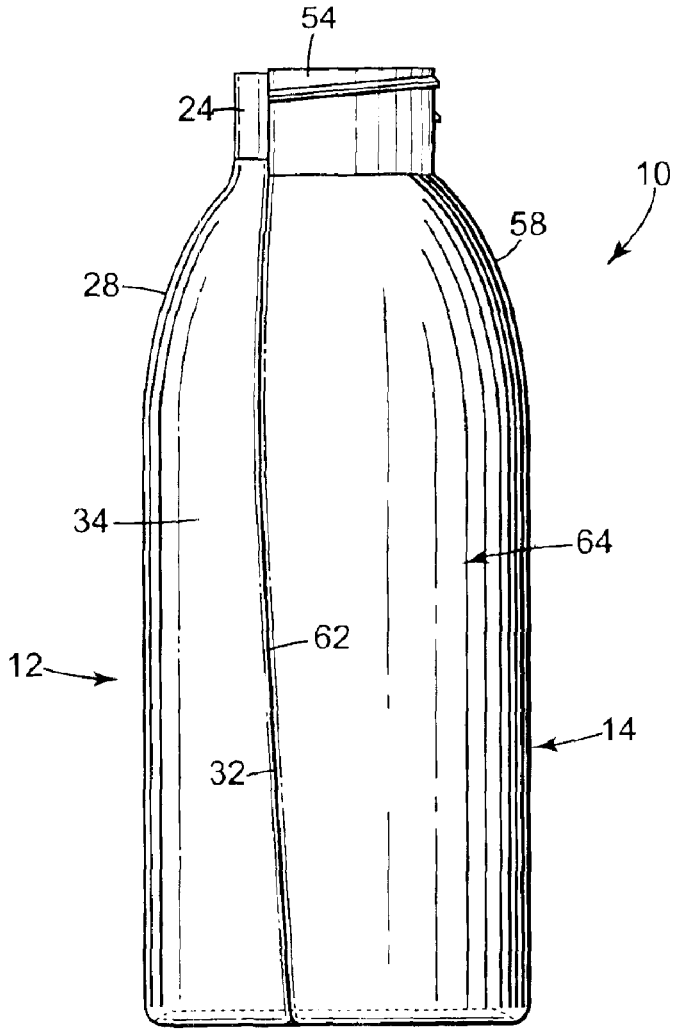
FIG. 5A is a side view of the first and second compartments assembled to one another.
Figure 5B:
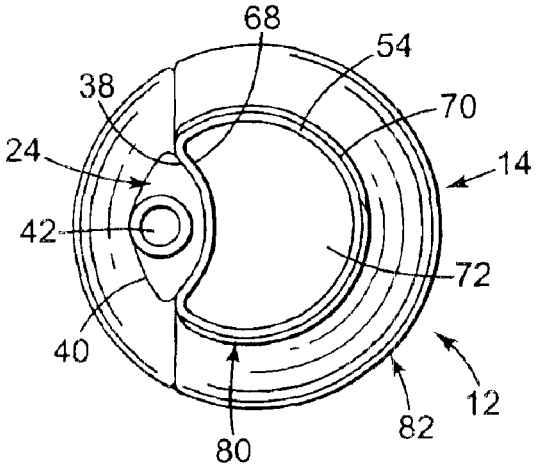
FIG. 5B is a top view of the assembly of FIG. 5A.

While the first and second compartments 12, 14 are preferably formed independent of one another, they are sized and shaped to effectuate a uniform appearance for the container 10 upon final assembly as shown in FIGS. 5A and 5B. In particular, the interior surfaces 32, 62 are sized and shaped to uniformly rest against one another along an entirety thereof. Thus, the interior surfaces 32, 62 having corresponding, reciprocal tapers (relative to vertical). In this regard, the taper of the interior surfaces 32, 62 can conform with the previously described preferred embodiments, or can assume a wide variety of other shapes or contours that promote assembly of the two compartments 12, 14. Further, the exterior surfaces 34, 64 are sized and contoured to form a substantially uniform, contiguous exterior for the container 10. In this regard, the shape and contour of the exterior surfaces 34, 64 at the point of intersection between the compartments 12, 14 are preferably identical. However, in one preferred embodiment, and as best shown in FIG. 5A, the exterior surfaces 34, 64 form differing contours at opposite sides of the container 10. More particularly, the exterior surface 34 of the first compartment 12, and in particular along the neck 28, preferably defines a more gradual taper than a corresponding portion of the exterior surface 64 of the second compartment neck 58. With this one preferred configuration, the container 10 provides a visual indication to a user (not shown) that the first compartment 12 defines a "front", whereas the second compartment 14 defines a "back". Then, during a pouring operation, a user is visually prompted to tilt the container 10 such that the spout 24 is below the mouth 54, for reasons described below. Alternatively, a more symmetrical appearance is also acceptable. Finally, the longitudinal side view of FIG. 5A illustrates that the second compartment 14 is preferably slightly taller than the first compartment 12, such that the mouth 54 extends slightly above the spout 24, preferably on the order of approximately 0.1 inch.

With specific reference to FIG. 5B, upon final assembly, the spout 24 and the mouth 54 abut one another, such that the passage 42 and the opening 72 are in close proximity to one another. In this regard, the spout 24 and the mouth 54 correspond with one another in size and shape. The mouth 54 preferably wraps about a portion of the spout 24 as shown in FIG. 5B to more closely position the passage 42 and the opening 72. For example, the inner wall 68 of the mouth 54 is concave in transverse shape, sized to receive the convexly-shaped inner wall 38 of the spout 24. Further, the outer walls 40, 70 correspond in transverse shape, preferably combining to define a substantially contiguous circle. In other words, the arc lengths and arc radii defined by the outer walls 40, 70 correspond with one another such that the outer wall 40 of the spout 24 effectively completes the transverse circle otherwise substantially defined by the outer wall 70 of the mouth 54. Further, though not specifically illustrated in FIG. 5B, the respective bottoms 20, 50 (FIG. 2) correspond with one another, forming a relatively contiguous circle (in transverse cross-section). The combination bottoms 20, 50 preferably have identical radii of curvature, so that the bottom 20, 50 has a diameter sized in conformance with "standard" cup holders available with most automobiles, approximately 2.4 inch (±0.5 inch) in diameter.

Figure 5C:
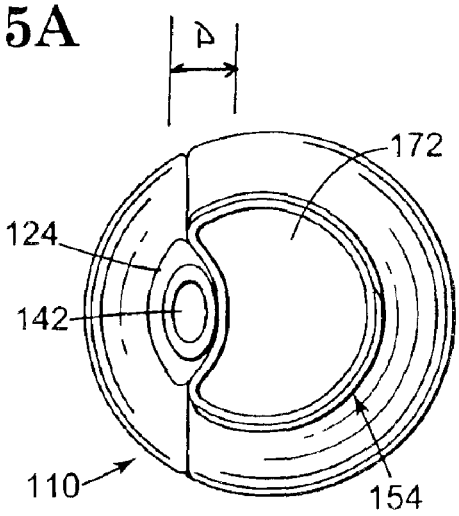
FIG. 5C is a top view of an alternative embodiment container in accordance with the present invention.

The spout 24 and the mouth 54 combine to define a pour region 80 for the container 10. With respect to the transverse, top view of FIG. 5B, the pour region 80 is offset from a maximum outer dimension (preferably diameter) or perimeter 82 of the container 10. In a preferred embodiment, the pour region 80 is transversely centered relative to the outer perimeter 82. In other words, the pour region 80 is preferably axially aligned with a longitudinal axis of a remainder or body of the container 10. With this one preferred configuration, the pour region 80 promotes uniform flow of two consumable products (not shown) from both of the compartments 12, 14 in close proximity to one another, with minimal concern for product clogging within a respective compartment during a pouring operation. As is evident from the view of FIG. 5B, the opening 72 defined by the mouth 54 has a larger transverse cross-sectional area than the passage 42 formed in the spout 24. This preferred characteristic conforms to the preferred consumable products contained by, and thus ultimately dispensed from, the respective compartments 12, 14. In particular, the first compartment 12 preferably contains a liquid consumable product (not shown) that will easily flow from the passage 42, whereas a dry consumable product (not shown) will flow less easily from the opening 72. It has surprisingly been found that by forming the opening 72 to have a transverse cross-section area that is at least three times greater than that of the passage 42, more preferably at least four times greater, most preferably at least five times greater, achieves desired product flow from each of the compartments 12, 14. Preferably, the passage 42 is positioned as close as possible to the opening 72. With this in mind, FIG. 5C depicts an alternative embodiment container 110 having a spout 124 forming a passage 142, and a mouth 154 forming an opening 172. The embodiment of FIG. 5C further minimizes a distance D from an inner edge of the opening 172 to an outer edge of the passage 142.

Returning to FIG. 1, the cap 16 is configured to preferably encompass both the mouth 54 and the spout 24. In one preferred embodiment, the cap 16 includes an internal thread (not shown) sized to threadably engage the thread 74 formed by the mouth 54. Alternatively, a wide variety of other closure methodologies can be employed. For example, separate or additional sealing devices can be provided for each of the spout 24 and the mouth 54. To this end, a foil membrane 76 known in the art is preferably sealed to the spout 24 across the passage 42. Even further, a removable plug can be forced into the passage 42. Regardless, the container 10 is provided with a cover(s) that selectively closes, either individually or in combination, the passage 42 and the opening 72.

The wrapper 18 is provided to secure the first compartment 12 and the second compartment 14. In one preferred embodiment, the wrapper 18 is a shrink label formed about the compartments 12, 14. Alternatively or in addition, a variety of other attachment techniques can be employed. For example, the first compartment 12 can be welded or glued to the second compartment 14. Further, the first and second compartments 12, 14 can be configured to frictionally engage each other upon final assembly, such as with a snap fit. Regardless, the first and second compartments 12, 14 are preferably relatively permanently assembled to one another so that a consumer is unlikely to separate or re-use the compartments 12, 14 individually.

While the compartments 12, 14 have been described as preferably integrally forming the spout 24 and the mouth 54, respectively, other constructions are also available. For example, the compartments 12, 14 can be formed as relatively straight (i.e., non-tapering) bodies, that following assembly to one another, have a separate cover placed across one or both compartments. The cover defines the necessary flow holes (i.e., the passage 42 (FIG. 3) and the opening 72 (FIG. 4)) for dispensing products from the respective compartments 12, 14. Regardless of the exact construction, the resulting flow hole associated with the first compartment (e.g., the passage 42) has a transverse cross-sectional area that is less than a maximum transverse cross-sectional area of the first compartment (e.g., $OD_1$ in FIG. 3). Similarly, the flow hole associated with the second compartment (e.g., the opening 72) has a transverse cross-sectional area that is less than a maximum transverse cross-sectional area of the second compartment (e.g., $OD_2$ in FIG. 4). In this way, the flow holes provide a controlled or restricted flow rate of consumable products from the container. Further, at least one of the flow holes is substantially centered relative to a transverse perimeter of the container, as shown, for example in FIG. 5B. That is to say, at least one of the flow holes is within 0.5 inches of being centered relative to the transverse perimeter of the container.

The preferred container 10 is available for containing a number of different consumable products. In a preferred embodiment, however, the first compartment 12 contains a liquid consumable product, preferably milk; and the second compartment 14 contains a dry consumable product, preferably a ready-to-eat cereal. With these preferred comestibles in mind, the container 10 is configured to promote storage of milk in a sterilized environment, preferably an aseptically sterile environment, to provide an extended shelf life or ultra-pasteurized product on a mass production basis. For example, one preferred method of manufacture in accordance with the present invention entails providing the first compartment 12 as previously described. The first compartment 12 is then sterilized. In this regard, regulations relating to storage of milk allow for an increased shelf life where the milk is stored within an aseptically sterilized environment. As such, the first compartment 12 is preferably aseptically sanitized with an appropriate sterilizing solution. A desired volume of milk (or other liquid consumable product) is then dispensed into the first compartment 12, again in a sterile environment. For example, four fluid ounces of milk are poured into the first compartment 12, although other volumes are equally acceptable. The first compartment 12 is then sealed, such as by applying the film or foil membrane 76 across the spout 24.

A dry consumable product, preferably ready-to-eat cereal, is dispensed into the second compartment 14. In this regard, a preferred dry consumable product is described in U.S. patent application Ser. No. 09/781,583, entitled "Portable Container Separately Containing Two Consumable Products, And a Dry Consumable Product, Especially RTE Cereal, For Use Therewith", filed on even date herewith, the teachings of which are incorporated by reference. Notably, the second compartment 14 is preferably sanitized prior to receiving the dry consumable product, but need not necessarily be aseptically sterilized. In this regard, the second compartment 14 can be filled at an area or room remote from the area or room at which the first compartment 12 is filled. Further, the first and second compartments 12, 14 can be filled with the respective consumable products concurrently, or at different points in time. In fact, a mass quantity of first compartments 12 can be filled with milk at one location, while a mass quantity of second compartments 14 are filled with ready-to-eat cereal at a different location. With this preferred methodology, there is no opportunity for the preferred aseptic sterilization solution to contact or otherwise deteriorate the quality of the ready-to-eat cereal (or other dry consumable product).

The first and second compartments 12, 14 are then assembled to one another, such as by securing the wrapper 18 about the compartments 12, 14. Alternatively, the second compartment 14 can be assembled to the first compartment 12 in an empty state, and the dry consumable product then dispensed into the second compartment 14. Regardless, once the second compartment 14 has been filled, the mouth 54 is covered, such as by a foil membrane 76 and/or the cap 16.

Figure 6:
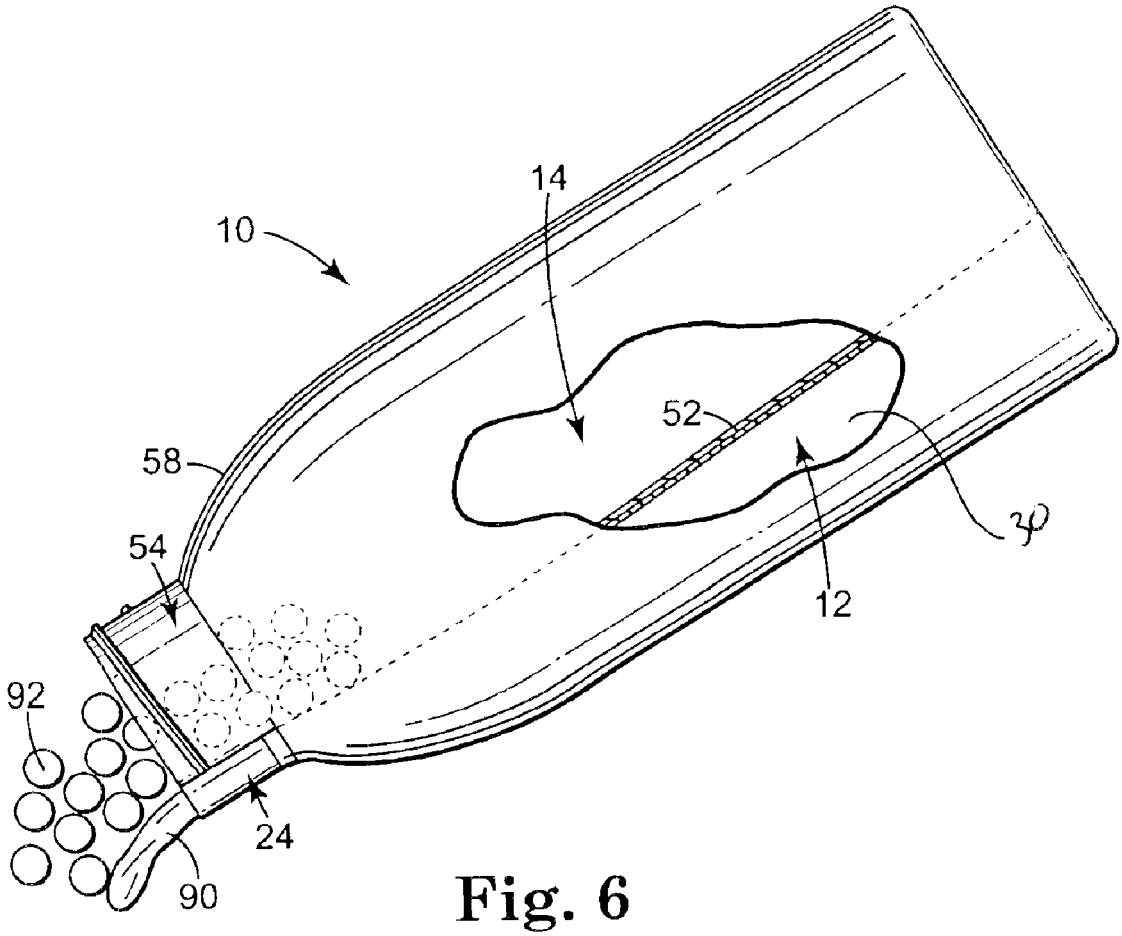
FIG. 6 is a side view of a packaged good article in accordance with the present invention during use.

Following manufacture, the container 10 is made available to a consumer (not shown). To consume the contained products, the consumer simply removes the cap 16 and any other closure devices (such as the foil membrane 76 otherwise applied to the spout 24). The container 10 is then grasped, preferably with a single hand, and directed toward the user's mouth (not shown). In this regard, it is preferred that the container 10 be oriented such that the mouth 54 is "above" the spout 24 as the container 10 is tilted, as shown, for example, in FIG. 6. This preferred orientation is suggested by one preferred configuration of the container 10, whereby the compartments 12, 14 have slightly differing contours that visually indicates to the consumer that the first compartment 12 is the "front" of the container 10, as previously described.

As the container 10 is tilted, milk (or other liquid consumable product) 90 flows from the first compartment 12 via the spout 24, and cereal (or other dry consumable product) 92 flows from the second compartment 14 via the mouth 54. Because the first compartment 12 is slightly shorter than the second compartment 14, the mouth 54 effectively prevents undesired backflow of milk 90 into the second compartment 14. In one preferred embodiment, the first compartment 12 is constructed to be relatively flexible or squeezable. As such, to temporarily increase the flow of milk 90 from the second compartment 12, the consumer (not shown) simply squeezes the first compartment 12. A consumer can further regulate the flow of milk 90 by simply placing his or her tongue over the spout 24, and in particular the passage 42 (FIG. 3). The passage 42 can be partially or entirely blocked, as desired, without interfering with the flow of cereal 92. Further, both products 90, 92 are easily, concurrently consumed by the consumer because the spout 24 and the mouth 54, and thus the passage 42 and the opening 72 (FIG. 4), are in close proximity to one another. Finally, with the second compartment 14 preferably being "over" the first compartment 12 during a pouring operation, the opportunity for obstruction of the cereal 92 within the second compartment 14, or at the opening 72, is minimized. In particular, as shown in phantom in FIG. 6, individual pieces of the cereal 92 easily flow along an interior of the second compartment side wall 52. Also, the tapered nature of the neck 58 guides the cereal 92 to the opening 72, and is thus free of any "hard" corner that might otherwise capture or negatively impact cereal flow. Between periods of consumption, the container 10 is sized for convenient storage within a "standard" cup holder.

Following consumption, the container 10 is preferably recycled or otherwise disposed of. In this regard, the container 10 is configured as a single use device. Because the first and second compartments 12, 14 are relatively permanently secured to one another, they cannot easily be disassembled. Further, the only access afforded to the internal storage region 30 of the first compartment 12 is via the passage 42 in the spout 24. To this end, the passage 42 is relatively small in transverse cross-section, rendering cleaning of the first compartment 12 by a consumer (not shown) virtually impossible. Thus, the consumer will not be tempted to reuse the container 10 to store milk (or other liquid consumable product) within the first compartment 12, as the first compartment 12 cannot be cleaned. Also, the relatively small size of the passage 42 greatly impedes refilling of the first compartment 12, further discouraging reuse of the container 10. To a lesser extent, the second compartment 14 presents the same beneficial obstacles due to the relatively small size of the opening 72 formed by the mouth 54. As a result, a preferred configuration of the container 10 eliminates the manufacturer risks otherwise associated with reusable designs.

The container of the present invention provides a marked improvement over previous designs. The dual, side-by-side compartment design separately contains both milk (or other liquid consumable product) and cereal (or other dry consumable product), and promotes simultaneous dispensing of the consumable products in close proximity to one another. To this end, a size of the respective passage in the first (or liquid) compartment and opening in the second (or dry) compartment promotes dispensing of desired aliquots of each product. Further, the method of manufacture of the container promotes containment of milk (or other liquid consumable product) in a preferably aseptically sanitized environment, resulting in a packaged good article with an enhanced shelf-life. The container is highly convenient from both a manufacturing and consumption vantage point.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof. For example, the first compartment has been described as preferably containing milk. Alternatively, other liquid consumable products, such as water, soda pop, juice, beer, coffee, etc. are equally acceptable. Similarly, the second compartment is not necessarily limited to a ready-to-eat cereal. Instead, other dry consumable products, such as nuts, crackers, chips, etc., can be contained. Even further, a dry consumable product can be contained by the first compartment and a liquid consumable product can be contained by the second compartment. Also, both compartments can contain a liquid consumable product or a dry consumable product.

What is claimed is:

1. A portable, single-use container for separately containing a first and a second consumable product, the container comprising:

a first compartment for containing a first consumable product, the first compartment tapering at an upper portion thereof to form a spout forming a passage along a spout internal surface; and a second compartment for containing a second consumable product, the second compartment tapering at an upper portion thereof to form a mouth forming an opening along a mouth internal surface;

wherein the first and second compartments are assembled to one another in a side-by-side fashion such that the mouth abuts the spout, and further wherein upon final assembly, the spout and mouth are positioned such that each of the respective internal surfaces define an interior section and an exterior section, the exterior section of the spout internal surface having a radius differing from a radius of the exterior section of the mouth internal surface.

2. The container of claim 1, wherein the first and second compartments each include a body portion having an exterior surface and an interior surface, the interior surfaces abutting each other upon final assembly.

3. The container of claim 2, wherein the respective interior surfaces are relatively planar.

4. The container of claim 1, wherein the first compartment includes a body portion, a neck, and the spout, the neck tapering in outer dimension from the body portion to the spout.

5. The container of claim 4, wherein the body portion of the first compartment defines an interior surface and an exterior surface, and further wherein the spout is substantially transversely aligned with the interior surface and substantially transversely offset from the exterior surface.

6. The container of claim 4, wherein the exterior surface of the first compartment body portion is arcuate in transverse cross-section, defining a maximum diameter, the spout being substantially centered relative to the maximum diameter.

7. The container of claim 1, wherein the second compartment includes a body portion, a neck, and the mouth, the neck tapering in outer dimension from the body portion to the mouth.

8. The container of claim 7, wherein the body portion of the second compartment defines an interior surface and an exterior surface, and further wherein the mouth is substantially transversely aligned with the interior surface and substantially transversely offset from the exterior surface.

9. The container of claim 7, wherein the exterior surface of the second compartment body portion is arcuate in transverse cross-section, defining a maximum diameter, the mouth being substantially transversely centered relative to the maximum diameter.

10. The container of claim 1, wherein the mouth is configured to wrap about a portion of the spout upon final assembly.

11. The container of claim 10, wherein a portion of the mouth is concave in transverse cross-section for wrapping about a portion of the spout.

12. The container of claim 11, wherein a portion of the spout is convex in transverse cross-section, corresponding with the concave portion of the mouth.

13. The container of claim 1, wherein upon final assembly, respective bottoms of the first and second compartments are substantially aligned, and the spout extends to a height less than a height of the mouth.

14. The container of claim 1, further comprising:

a film wrapped about the first and second compartments to secure the first compartment to the second compartment.

15. The container of claim 1, further comprising:

a membrane secured across the passage defined by the spout to seal the first compartment.

16. The container of claim 1, further comprising:

a cap selectively secured to the mouth.

17. The container of claim 16, wherein the cap selectively encompasses the mouth and the spout.

18. The container of claim 16, wherein the mouth defines an opening, and further wherein the container is adapted to require complete removal of the cap from the mouth to expose the opening.

19. The container of claim 1, wherein the radius of the exterior section of the spout internal surface is less than the radius of the exterior section of the mouth internal surface.

20. The container of claim 1, wherein the first compartment contains milk and the second compartment contains cereal.

21. A portable, single-use packaged good article comprising:

a first compartment tapering at an upper portion thereof to form a spout having a curved, convex interior wall;

a first consumable product contained within the first compartment;

a second compartment formed separate of the first compartment and tapering at an upper portion thereof to form a mouth having a curved, concave interior wall;

a second consumable product contained within the second compartment;

wherein the first and second compartments are assembled to one another in a side-by-side fashion such that the mouth abuts the spout, the first consumable product being contained separate from the second consumable product.

22. The packaged good article of claim 21, wherein the first consumable product is a liquid consumable product and the second consumable product is a dry consumable product.

23. The packaged good article of claim 22, wherein the liquid consumable product is milk and the dry consumable product is cereal.

24. The container of wherein the spout defines a circle in transverse cross-section and the mouth defines a non-circle in transverse cross-section.

25. A portable, single-use container for separately containing a first and a second consumable product, the container comprising:

a first compartment for containing a first consumable product;

a second compartment for containing a second consumable product, the first and second compartments being secured to one another in a side-by-side fashion and combining to define a body of the container;

a first compartment opening for dispensing a first consumable product from the first compartment, the first compartment opening having a transverse cross-sectional area less than a maximum transverse cross-sectional area of the first compartment; and a second compartment opening for dispensing a second consumable product from the second compartment, the second compartment opening including a transverse concave section and having a transverse cross-sectional area less than a maximum transverse cross-sectional area of the second compartment, the transverse cross-sectional area of the second compartment opening being greater than the transverse cross-sectional area of the first compartment opening;

wherein at least one of the first and second compartment openings is substantially centered relative to the body.

26. The container of claim 25, wherein the first and second compartment openings are positioned side-by-side upon final assembly to define a pour region for the container, the pour region having a central axis substantially aligned with a central axis of the body.

27. The container of claim 26, wherein the body and the pour region are substantially circular in transverse cross-section.

28. The container of claim 25, wherein the first and second compartment openings are defined by respective side walls configured such that a portion of the second compartment opening side wall wraps about a portion of the first compartment opening side wall.

29. The container of claim 28, wherein the concave section is configured to receive a corresponding convex section of the first compartment opening side wall.

30. The container of claim 25, wherein the first compartment includes an integrally formed spout defining the first compartment opening.

31. The container of claim 30, wherein the second compartment includes an integrally formed mouth defining the second compartment opening.

32. The container of claim 31, wherein upon final assembly, respective bottoms of the first and second compartments are substantially aligned, and the spout extends to a height less than a height of the mouth.

33. The container of claim 25, further comprising:

a film wrapped about the first and second compartments to secure the first compartment to the second compartment.

34. The container of claim 25, further comprising:

a film secured across the first compartment opening for sealing the first compartment.

35. The container of claim 25, further comprising:

a cap selectively secured over the second compartment opening.

36. The container of claim 35, wherein the cap selectively encompasses the first and second compartment openings.

37. The container of claim 25, wherein the first compartment contains milk and the second compartment contains cereal.

38. A method of manufacturing a portable, single-use container separately containing two consumable products, the method comprising:

providing a first compartment tapering at an upper portion thereof to form a spout;

providing a second compartment tapering at an upper portion thereof to form a mouth, the first and second compartment being configured for assembly to one another in a side-by-side fashion;

dispensing a first consumable product into the first compartment;

covering the spout separate of the mouth with a seal that seals the first consumable product within the first compartment;

dispensing a second consumable product into the second compartment;

assembling the first and second compartments to one another; and covering the mouth and the seal with a cover;

wherein upon final assembly, the mouth abuts the spout.

39. The method of claim 38, wherein the second compartment is assembled to the first compartment before dispensing the second consumable product.

40. The method of claim 38, wherein the second compartment is assembled to the first compartment after dispensing the second consumable product.

41. The method of claim 38, further comprising:

aseptically sterilizing the first compartment before dispensing the first consumable product.

42. The method of claim 38, wherein the first consumable product is a liquid consumable product and the second consumable product is a dry consumable product.

43. The method of claim 42, wherein the liquid consumable product is milk and further wherein dispensing milk occurs in an aseptically sterilized environment.

44. The method of claim 38, wherein assembly of the first and second compartments includes:

wrapping a shrink label about the first and second compartments.

45. The method of claim 38, wherein covering the second compartment includes selectively securing a cap over the mouth and the spout.

46. The method of claim 38, wherein the spout and the mouth combine to define a pour region, and further wherein assembling the first and second compartments includes substantially centering the pour region relative to a remainder of the container.

* * * * *